US005998358A

United States Patent [19]

Herdt et al.

[11] Patent Number: 5,998,358

[45] Date of Patent: Dec. 7, 1999

[54] ANTIMICROBIAL ACID CLEANER FOR USE ON ORGANIC OR FOOD SOIL

[75] Inventors: Brandon L. Herdt, Newport; David A. Halsrud, Minneapolis, both of Minn.

[73] Assignee: Ecolab Inc., St. Paul, Mass.

[21] Appl. No.: 09/275,065

[22] Filed: Mar. 23, 1999

[51] Int. Cl.[6] ..... C11D 3/30; C11D 7/08; C11D 3/43

[52] U.S. Cl. ..... 510/506; 510/197; 510/199; 510/218; 510/253; 510/271; 510/362; 510/382; 510/398; 510/434; 510/436; 510/467; 510/477; 510/499; 510/332; 510/512; 510/510; 510/432; 510/269

[58] Field of Search ..... 510/197, 199, 510/218, 253, 271, 362, 382, 398, 434, 436, 467, 477, 499, 332, 512, 506, 510, 432, 269

[56] References Cited

U.S. PATENT DOCUMENTS

| | | | |
|---|---|---|---|
| 4,247,408 | 1/1981 | Imamura et al. | 252/143 |
| 4,396,521 | 8/1983 | Borrello | 252/118 |
| 4,501,680 | 2/1985 | Aszman et al. | 252/142 |
| 4,579,676 | 4/1986 | Bull | 252/94 |
| 4,587,030 | 5/1986 | Casey | 252/92 |
| 4,594,175 | 6/1986 | Copeland | 252/99 |
| 4,624,713 | 11/1986 | Morganson et al. | 134/25.2 |
| 4,699,728 | 10/1987 | Riehm et al. | 252/142 |
| 4,749,508 | 6/1988 | Cockrell, Jr. et al. | 252/136 |
| 4,921,627 | 5/1990 | Copeland et al. | 252/99 |
| 4,935,065 | 6/1990 | Bull | 134/22.13 |
| 5,000,867 | 3/1991 | Heinhuis-Walther et al. | 252/106 |
| 5,364,551 | 11/1994 | Lentsch et al. | 252/156 |
| 5,389,284 | 2/1995 | van der Hoeven et al. | 252/174.22 |
| 5,407,700 | 4/1995 | Man et al. | 427/154 |
| 5,409,713 | 4/1995 | Lokkesmoe et al. | 424/616 |
| 5,419,908 | 5/1995 | Richter et al. | 424/405 |
| 5,436,008 | 7/1995 | Richter et al. | 424/405 |
| 5,437,868 | 8/1995 | Oakes et al. | 424/405 |
| 5,462,681 | 10/1995 | Gutzmann et al. | 252/11 |
| 5,464,477 | 11/1995 | Awad | 134/1 |
| 5,472,629 | 12/1995 | Lysy et al. | 252/142 |
| 5,489,434 | 2/1996 | Oakes et al. | 424/405 |
| 5,597,793 | 1/1997 | Besse et al. | 510/434 |
| 5,707,952 | 1/1998 | Lambremont et al. | 510/362 |
| 5,712,241 | 1/1998 | Gorlin et al. | 510/426 |
| 5,716,260 | 2/1998 | Griffin et al. | 451/87 |
| 5,723,418 | 3/1998 | Hei et al. | 508/511 |
| 5,744,439 | 4/1998 | Bonett | 510/247 |
| 5,750,484 | 5/1998 | Falbaum et al. | 510/276 |
| 5,797,986 | 8/1998 | Rolando et al. | 134/6 |
| 5,861,366 | 1/1999 | Ihns et al. | 510/320 |
| 5,871,590 | 2/1999 | Hei et al. | 134/26 |

*Primary Examiner*—Yogendra Gupta
*Assistant Examiner*—Charles Boyer
*Attorney, Agent, or Firm*—Merchant & Gould P.C.

[57] ABSTRACT

The invention relates to compositions and methods for cleaning typically organic beverage and food soils. The cleaning composition is formulated to remove carbohydrate and proteinaceous soils from hard surfaces. The formulations of the invention are directed to remove carbohydrate and proteinaceous soils from beverage manufacturing locations such as soils arising in the manufacture of malt beverages, fruit juices, dairy products, etc.

33 Claims, No Drawings

ANTIMICROBIAL ACID CLEANER FOR USE ON ORGANIC OR FOOD SOIL

FIELD OF THE INVENTION

The invention relates to acid cleaning compositions formulated for organic soil removal or, more particularly for food soil removal. Further, the invention relates to cleaning processes for the purpose of removing carbohydrate and proteinaceous soils from beverage manufacturing locations using a clean-in-place method. The cleaning compositions of the invention are formulated in an aqueous acid system and are directed to removing carbohydrate and proteinaceous soils from a hard surface.

BACKGROUND OF THE INVENTION

In the manufacture of foods and beverages, hard surfaces commonly become contaminated with carbohydrate, proteinaceous, hardness soils and other soils. Such soils can arise from the manufacture of both liquid and solid foodstuffs. Carbohydrate soils including cellulosics, monosaccharides, disaccharides, oligosaccharides, starches, gums and other complex materials, when dried, can form tough, hard to remove soils particularly when combined with other soil types. Similarly, other materials arising from foodstuffs including proteins, enzymes, fats and oils can also form contaminating, hard to remove soil, residues. One particular problem in the manufacture of beverages such as malt beverages, fruit juices such a citrus products, dairy products and others, can be the removal of largely carbohydrate soils that can also contain other soil components such as proteins, enzymes, fats, oils and others. The removal of such carbohydrate soils can be a significant problem.

Prior art compositions formulated for soil removal include various disclosures relating to acid cleaners containing a formulated detergent composition. Casey, U.S. Pat. No. 4,587,030 discloses a composition formulated to remove soap scum and hardness components using an aqueous base containing a surfactant system, and formulations of an amine oxide and cosolvent. Reihm et al., U.S. Pat. No. 4,699,728 discloses a fiberglass cleaner composition containing an organophosphonic acid/acrylic acid sequestrant in combination with a betaine surfactant. Heinhuis-Walther et al., U.S. Pat. No. 5,000,867 discloses a disinfectant composition comprising quaternary ammonium antimicrobials combined with organic and/or inorganic acids. Oaks et al, U.S. Pat. No. 5,437,868 discloses acidic peroxyacid antimicrobial compositions that can be formulated with functional materials. Gorin et al., U.S. Pat. No. 5,712,241 discloses a light duty liquid detergent containing a specific surfactant system. Ihns et al., U.S. Pat. No. 5,861,366 discloses soil removing agents containing an enzyme in formulations specifically designed to enhance proteolytic soil removal.

In formulating effective cleaning materials, formulators are constrained by available low cost materials, the use of materials that provide useful properties and compatibility and stability of the ingredients used. Combining acidic materials, and other materials such as enzymes can pose stability problems for the active materials. Further. obtaining cleaning and bactericidal effectiveness including a sanitizing effect is difficult for common formulator applications. Many of the formulations in the prior art have stability limitations or do not provide sufficient cleaning and sanitizing to be effective in the clean-in-place food or beverage applications.

Clean-in-place cleaning techniques are a specific cleaning regimen adapted for removing soils from the internal components of tanks, lines, pumps and other process equipment used for processing typically liquid product streams such as beverages, milk, juices, etc. Clean-in-place cleaning involves passing cleaning solutions through the system without dismantling any system components. The minimum clean-in-place technique involves passing the cleaning solution through the equipment and then resuming normal processing. Any product contaminated by cleaner residue can be discarded. Often clean-in-place methods involve a first rinse, the application of the cleaning solutions, a second rinse with potable water followed by resumed operations. The process can also include any other contacting step in which a rinse, acidic or basic functional fluid, solvent or other cleaning component such as hot water, cold water, etc. can be contacted with the equipment at any step during the process. Often the final potable water rinse is skipped in order to prevent contamination of the equipment with bacteria following the cleaning sanitizing step. The formulations of the invention that can be used in the clean-in-place technique typically comprise a mineral acid optionally in combination with an organic acid, a hydrocarbon ether solvent or a hydrocarbon alcohol solvent, a sequestrant composition, an ether amine composition and a variety of surfactant materials.

A substantial need exists for improved soil removal detergents and methods using acidic formulations. Further, a substantial need exists for compositions and methods for removing soil from hard surfaces such as conduits, tanks and pumps used in beverage manufacture using a clean-in-place technique.

BRIEF DISCUSSION OF THE INVENTION

We have found improved acid formulations that have enhanced capacity for the removal of common food soils in a method to clean hard surfaces in a CIP regimen. Further, we have found a method for removing carbohydrate and other food soil residues from beverage manufacturing equipment using clean-in-place techniques. The compositions must include a food grade or food compatible acid, a solvent material and either an ether amine or a quaternary ammonium compound. The unique compositions of the invention comprise an acid source such as a food grade mineral acid including phosphoric acid, sulfamic acid, hydroxy carboxylic acids, etc. The formulations also contain a solvent system comprising a lower alkanol or alkyl ether lower alcohol solvent, a sequestrant composition, an alkyl ether amine composition and other optional ingredients such as added acid, other surfactant ingredients, phosphonate surfactants, added solvent and other compositions. Formulations without surfactant can clean surprisingly well. These materials can be used in an acid aqueous solution and can be contacted with hard surfaces for soil removal. These compositions are particularly effective in removing carbohydrate soils from beverage locations using a clean-in-place technique. When used in food preparation, conduits, tanks, pumps, lines and other components of beverage manufacturing units can rapidly be contaminated with carbohydrate soils. These soils can be rapidly removed using the compositions of the invention. Typically, the compositions of the invention are contacted with the beverage manufacturing unit and are directed through the lines, tanks, conduits, pumps, etc. of the manufacturing unit removing carbohydrate soils until the unit is substantially residue free. Once the compositions have removed harmful soil residues, the compositions are removed from the manufacturing unit and beverage production is re-initiated. If necessary, a rinse step can be utilized between the cleaning step and beverage manufacture. Alternatively, beverage manufacture can be re-initiated using the beverage to remove clean residue from the system, discarding contaminated beverage.

DETAILED DISCUSSION OF THE INVENTION

Briefly, the acidic cleaning compositions of this invention are formed from a major proportion of water, a food grade or food compatable acidic component comprising an inorganic acid or organic acid or combinations thereof. The acidic component used to prepare the acidic compositions of the invention that can be dissolved in the aqueous organic cosolvent system of the invention to produce an acidic pH in the range of about 1 to 5. A pH substantially less than about 1 can result in substantial corrosion of metal and other surfaces common in the cleaning environment, while a pH greater than about 5 can unacceptably reduce the cleaning efficiency of the composition.

Most common commercially-available inorganic and organic acids can be used in the invention. Examples of useful inorganic acids include phosphoric acid and sulfamic acid. Useful weak organic acids include acetic acid, hydroxyacetic acid, glycolic acid, citric acid, benzoic acid, tartaric acid and the like. I have found in many applications that a mixture of a weak organic and a weak inorganic acid in the composition can result in a surprising increase in cleaning efficacy. Preferred cleaning systems comprise the combination of an organic acid such as citric acid, acetic acid, or hydroxyacetic acid (glycolic acid) and phosphoric acid. The most preferred acid cleaning system comprises either lactic acid or phosphoric acid.

In the case of phosphoric acid-lactic acid systems, the weight ratio of phosphoric acid to hydroxyacetic acid is preferably about 15:1 to 1:1, most preferably about 8–1.5:1. I have found that one type of difficult soil to remove from surfaces appears to be carbohydrate soils that can be contaminated with proteinaceous soils and inorganic soils such as $CaHPO_4$, etc. This component is part of many soils and can be a result of the interaction between hardness components and acid-containing cleaners using phosphoric acid as the acidic component. We believe a mixture of lactic acid with the phosphoric acid in the acidic cleaner can optimize cleaning properties. However, in some locales, the phosphate content permitted in cleansing compositions is restricted or must be limited to a negligible amount.

Water conditioning agents function to inactivate water hardness and prevent calcium and magnesium ions from interacting with soils, surfactants, carbonate and hydroxide. Water conditioning agents therefore improve detergency and prevent long term effects such as insoluble soil redepositions, mineral scales and mixtures thereof. Water conditioning can be achieved by different mechanisms including sequestration, precipitation, ion-exchange and dispersion (threshold effect). Metal ions such as calcium and magnesium do not exist in aqueous solution as simple positively charged ions. Because they have a positive charge, they tend to surround themselves with water molecules and become solvated. Other molecules or anionic groups are also capable of being attracted by metallic cations. When these moieties replace water molecules, the resulting metal complexes are called coordination compounds. An atom, ion or molecule that combines with a central metal ion is called a ligand or complexing agent. A type of coordination compound in which a central metal ion is attached by coordinate links to two or more nonmetal atoms of the same molecule is called a chelate. A molecule capable of forming coordination complexes because of its structure and ionic charge is termed a chelating agent. Since the chelating agent is attached to the same metal ion at two or more complexing sites, a heterocyclic ring that includes the metal ions is formed. The binding between the metal ion and the liquid may vary with the reactants; but, whether the binding is ionic, covalent or hydrogen bonding, the function of the ligands is to donate electrons to the metal.

Ligands form both water soluble and water insoluble chelates. When a ligand forms a stable water soluble chelate, the ligand is said to be a sequestering agent and the metal is sequestered. Sequestration therefore, is the phenomenon of typing up metal ions in soluble complexes, thereby preventing the formation of undesirable precipitates. The builder should combine with calcium and magnesium to form soluble, but undissociated complexes that remain in solution in the presence of precipitating anions. Examples of water conditioning agents which employ this mechanism are the condensed phosphates, glassy polyphosphates, phosphonates, amino polyacetates, and hydroxycarboxylic acid salts and derivatives. Like ligands which inactivate metal ions by precipitations similar effect is achieved by simple supersaturation of calcium and magnesium salts having low solubility. Typically carbonates and hydroxides achieve water conditioning by precipitation of calcium and magnesium as respective salts. Orthophosphate is another example of a water conditioning agent which precipitates water hardness ions. Once precipitated, the metal ions are inactivated.

Water conditioning can also be affected by an in situ exchange of hardness ions from the detersive water solution to a solid (ion exchanger) incorporated as an ingredient in the detergent. In detergent art, this ion exchanger is an aluminosilicate of amorphoric or crystalline structure and of naturally occurring or synthetic origin commercially designated as zeolite. To function properly, the zeolite must be of small particle size of about 0.1 to about 10 microns in diameter for maximum surface exposure and kinetic ion exchange. The water conditioning mechanisms of precipitation sequestration and ion exchange are stoichiometric interactions requiring specific mass action proportions of water conditioner to calcium and magnesium ion concentrations. Certain sequestering agents can further control hardness ions at substoichiometric concentrations. This property is called the "threshold effect" and is explained by an adsorption of the agent onto the active growth sites of the submicroscopic crystal nuclei which are initially produced in the supersaturated hard water solution, i.e., calcium and magnesium salts. This completely prevents crystal growth, or at least delays growth of these crystal nuclei for a long period of time. In addition, threshold agents reduce the agglomeration of crystallites already formed. Compounds which display both sequestering and threshold phenomena with water hardness minerals are much preferred conditioning agents for employ in the present invention. Examples include tripolyphosphate and the glassy polyphosphates, phosphonates, and certain homopolymers and copolymer salts of carboxylic acids. Often these compounds are used in conjunction with the other types of water conditioning agents for enhanced performance. Combinations of water conditioners having different mechanisms of interaction with hardness result in binary, ternary or even more complex conditioning systems providing improved detersive activity.

The water conditioning agents which can be employed in the detergent compositions of the present invention can be inorganic or organic in nature; and, water soluble or water insoluble at use dilution concentrations. Useful examples include all physical forms of alkali metal, ammonium and substituted ammonium salts of carbonate, bicarbonate and sesquicarbonate; pyrophrophates, and condensed polyphosphates such as tripolyphosplhate, trimethylphosphite and ring open derivatives; and, glassy polymeric metaphosphate of general structure $M_{n+2}P_nO_{3n+1}$ having a degree of polymerization n of from about 6 to about 21 in anhydrous or hydrated forms; and, mixtures thereof.

Aluminosilicate builders are useful in the present invention. Useful aluminosilicate ion exchange materials are commercially available. These aluminosilicates can be amorphous or crystalline in structure and can be naturally-occurring aluminosilicates or synthetically derived.

Organic water soluble water conditioning agents useful in the compositions of the present invention include aminpolyacetates, polyphosphonates, aminopolyphosphonates, short chain carboxylates and a wide variety of polycarboxylate compounds. Organic water conditioning agents can generally be added to the composition in acid form and neutralized in situ; but, can also be added in the form of a pre-neutralized salt. When utilized in salt form, alkali metals such as sodium, potassium and lithium; or, substituted ammonium salts such as from mono-, di- or triethanolammonium cations are generally preferred.

Polyphosphonates useful herein specifically include the sodium, lithium and potassium salts of ethylene diphosphonic acid; sodium, lithium and potassium salts of ethane-1-hydroxy-1,1-diphosphonic acid and sodium lithium, potassium, ammonium and substituted ammonium salts of ethane-2-carboxy-1,1-diphosphonic acid, amino-(trimethylenephosphonic acid) and salts thereof, hydroxymethanediphosphonic acid, carbonyldiphosphonic acid, ethane-1-hydroxy-1,1,2-triphosphonic acid, ethane-2-hydroxy-1,1,2-triphosphonic acid, propane-1,1,3,3-tetraphosphonic acid propane-1,1,2,3-tetraphosphonic acid and propane 1,2,2,3-tetraphosphonic acid; and mixtures thereof. Examples of these polyphosphonic compounds are disclosed in British Pat. No. 1,026,366. For more examples see U.S. Pat. No. 3,213,030 to Diehl issued Oct. 19, 1965 and U.S. Pat. No. 2,599,807 to Bersworth issued Jun. 10, 1952.

The water soluble aminopolyphosphonic acids, or salts thereof, compounds are excellent water conditioning agents and may be advantageously used in the present invention. Suitable examples include soluble salts, e.g. sodium, lithium or potassium salts, of amino-(trimethylenephosphonic acid) diethylene diamine pentamethylene phosphonic acid, ethylene diamine tetramethylene phosphonic acid, hexamethylenediamine tetramethylene phosphonic acid, and nitrilotrimethylene phosphonic acid; and, mixtures thereof. Water soluble short chain carboxylic acid salts constitute another class of water conditioner for use herein. Examples include citric acid, gluconic acid and phytic acid. Preferred salts are prepared from alkali metal ions such as sodium, potassium, lithium and from ammonium and substituted ammonium.

Suitable water soluble polycarboxylate water conditioners for this invention include the various ether polycarboxylates, polyacetal, polycarboxylates, epoxy polycarboxylates, and aliphatic-, cycloalkane- and aromatic polycarboxylates. Greater detail is disclosed in U.S. Pat. No. 3,635,830 to Lamberti et al. issued Jan. 18, 1972, incorporated herein by reference. Water soluble polyacetal carboxylic acids or salts thereof which are useful herein as water conditioners are generally described in U.S. Pat. No. 4,144,226 to Crutchfield et al. issued Mar. 13, 1979 and U.S. Pat. No. 4,315,092 to Crutchfield et al. issued Feb. 9, 1982.

Water soluble polymeric aliphatic carboxylic acids and salts preferred for application are compositions of this invention are selected from the groups consisting of:

(a) a water soluble salts of homopolymers of aliphatic polycarboxylic acids (b) water soluble salts of copolymers of at least two of the monomeric species having the empirical formula described in (a), and (c) water soluble salts of copolymers of a member selected from the group of alkylenes and monocarboxylic acids with the aliphatic polycarboxylic compounds The most preferred water conditioner for use in the most preferred embodiments of this invention are water soluble polymers of acrylic acid, acrylic acid copolymers; and derivatives and salts thereof.

Such polymers include polyacrylic acid, polymethacrylic acid, acrylic acidmethacrylic acid copolymers, hydrolyzed polyacrylamide, hydrolyzed polymethacrylamide, hydrolyzed acrylamidemethacrylamide copolymers, hydrolyzed polyacrylonitrile, hydrolyzed polymethacrylonitrile, hydrolyzed acrylonitrilemethacrylonitrile copolymers, or mixtures thereof. Water soluble salts or partial salts of these polymers such as the respective alkali metal (e.g. sodium, lithium potassium) or ammonium and ammonium derivative salts can also be used. The weight average molecular weight of the polymers is from about 500 to about 15,000 and is preferably within the range of from 750 to 10,000. Preferred polymers include polyacrylic acid, the partial sodium salt of polyacrylic acid or sodium polyacrylate having weight average molecular weights within the range of 1,000 to 5,000 or 6,000. These polymers are commercially available, and methods for their preparation are wellknown in the art.

For example, commercially available polyacrylate solutions useful in the present cleaning compositions include the sodium polyacrylate solution, Colloid® 207 (Colloids, Inc., Newark, N.J.), the polyacrylic acid solution, Aquatreat® AR-602-A (Alco Chemical Corp., Chattanooga, Tenn.); the polyacrylic acid solutions (50–65% solids) and the sodium polyacrylate powers (M.W. 2,100 and 6,000) and solutions (45% solids) available as the Goodrite® K-700 series from B.F. Goodrich Co., and the sodium or partial sodium salts of polyacrylic acid solutions (M.W. 1000 to 4500) available as the Acusol series® from Rohm and Haas. Of course combinations and admixtures of any of the above enumerated water conditioning agents may be advantageously utilized within the embodiments of the present invention.

Generally, the concentration of water or conditioner mixture useful in use dilution, solutions of the present invention ranges from about 0.0005% (5 ppm) by active weight to about 0.04% (400 ppm) by active weight, preferably from about 0.001% (10 ppm) by active weight to about 0.03% (300 ppm) by active weight, and most preferably from about 0.002% (20 ppm) by weight to about 0.02% (200 ppm) by active weight.

The concentration of water or conditioner mixture useful in the most preferred concentrated embodiment of the present invention ranges from about 1.0% by active weight to about 35% by active weight of the total formula weight percent of the builder containing composition.

Also commonly used are polyols containing only carbon, hydrogen and oxygen atoms. They preferably contain from about 2 to about 6 carbon atoms and from about 2 to about 6 hydroxy groups. Examples include 1,2-propanediol, 1,2-butanediol, hexylene glycol, glycerol, sorbitol, mannitol, and glucose. Nonaqueous liquid carrier or solvents can be used for varying compositions of the present invention. These include the higher glycols, polyglycols, polyoxides and glycol ethers. Suitable substances are alkyl ether alcohols such as methoxyethanol, methoxyethanol acetate, butyoxy ethanol (butyl cellosolve), propylene glycol, polyethylene glycol, polypropylene glycol, diethylene glycol monoethyl ether, diethylene glycol monopropyl ether, diethylene glycol monobutyl ether, tripropylene glycol methyl ether, propylene glycol methyl ether (PM), dipropylene glycol methyl ether (DPM), propylene glycol methyl ether acetate (PMA), dipropylene glycol methyl ether acetate (CPMA), ethylene glycol n-butyl ether, 1,2-dimethoxycthane, 2-ethoxy ethanol, 2-ethoxy-ethylacctate, phenoxy ethanol, and ethylene glycol n-propyl ether. Other useful solvents are ethylene oxide/propylene oxide, liquid random copolymer such as Synalox® solvent series from Dow Chemical (e.g., Synalox® 50–50B). Other suitable solvents are propylene glycol ethers such as PnB, DpnB and TpnB (propylene glycol mono n-butyl ether, dipropylene glycol and tripropylene glycol mono n-butyl ethers sold by Dow Chemical under the trade name Dowanol®. Also tripropylene glycol mono methyl ether "TPM Dowanol®" from Dow Chemical is suitable.

The aqueous cleaners of the invention comprises an amine compound. The amine compound functions to enhance compositional cleaning, further antimicrobial character, and reduce or eliminate the formation of various precipitates resulting from the dilution of water and/or contaminants on the surface of application.

The amine compounds of the invention may comprise any number of species. Preferably, the amine compound is an alkyl ether amine compound of the formulae,

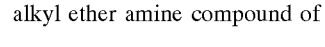

$$R_1—O—R_2—NH_2, \quad (1)$$

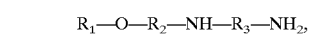

$$R_1—O—R_2—NH—R_3—NH_2, \quad (2)$$

and mixtures thereof, wherein $R_1$ may be a linear saturated or unsaturated $C_{6-18}$ alkyl, $R_2$ may be a linear or branched $C_{1-8}$ alkyl, and R3 may be a linear or branched $C_{1-8}$ alkyl. More preferably, $R_1$ is a linear $C_{12-16}$ alkyl; $R_2$ is a $C_{2-6}$ linear or branched alkyl and $R_3$ is a $C_{2-6}$ linear or branched alkyl.

Preferred compositions of the invention include linear alkyl ether diamine compounds of formula (2) wherein R is $C_{12-16}$, $R_2$ is $C_{2-4}$, and $R_3$ is $C_{2-4}$ alkyl. When the amine compound used is an amine of formulas (1) and (2), $R_1$ is either a linear alkyl $C_{12-16}$ or a mixture of linear alkyl $C_{10-12}$and $C_{14-16}$. Overall the linear alkyl ether amine compounds used in the composition of the invention provide lower use concentrations, upon dilution with enhanced soil removal. The amount of the amine compound in the concentrate generally ranges from about 0.1 wt-% to 90 wt-%, preferably about 0.25 wt-% to 75 wt-% and more preferably about 0.5 wt-% to 50 wt-%. These materials are commercially available from Tomah Products Incorporated as PA-10, PA-19, PA-1618, PA-1816, DA-18, DA-19, DA-1618, DA-1816, and the like. The use dilution of the concentrate is preferably calculated to get disinfectant or sanitizing efficacy in the intended application or use. Accordingly the active amine compound concentration in the composition of the invention ranges from about 10 ppm to 10000 ppm, preferably from about 20 ppm to 7500 ppm, and most preferably about 40 ppm to 5000 ppm.

As a substitute for all or a part of the ether amine compound described above, quaternary ammonium compounds can be used.

Suitable quaternary compounds include generally the quaternary ammonium salt compounds which may be described as containing, in addition to the usual halide (chloride, bromide, iodide, etc.), sulfate, phosphate, or other anion, aliphatic and/or alicyclic radicals, preferably aldyl and/or aralkyl, bonded through carbon atoms therein to the remaining 4 available positions of the nitrogen atom, 2 or 3 of which radicals may be joined to form a heterocycle with the nitrogen atom, at least one of such radicals being aliphatic with at least 8, up to 22 or more, carbon atoms.

Suitable agents which may be incorporated are quaternary ammonium salts of the formula:

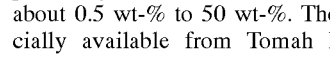

$$[R_1R_2R_3R_4N]^+Y^-$$

wherein at least one, but not more than two, of $R_1$, $R_2$, $R_3$, and $R_4$ is an organic radical containing a group selected from a $C_6$–$C_{22}$ aliphatic radical, or an alkyl phenyl or alkyl benzyl radical having 10–16 atoms in the alkyl chain, the remaining group or groups being selected from hydrocarbyl groups containing from 1 to about 4 carbon atoms, or $C_2$–$C_4$ hydroxyl alkyl groups and cyclic structures in which the nitrogen atom forms part of the ring, and Y is an anion such as halide, methylsulphate, or ethylsulphate.

In the context of the above definition, the hydrophobic moiety (i.e. the $C_{16}$–$C_{22}$ aliphatic, $C_{10}$–$C_{16}$ alkyl phenyl or alkyl benzyl radical) in the organic radical $R_1$ may be directly attached to the quaternary nitrogen atom or may be indirectly attached thereto through an amide, esters, alkoxy, ether, or like grouping.

The quaternary ammonium agents can be prepared in various ways well known in the art. Many such materials are commercially available.

As illustrative of such cationic detergents, there may be mentioned distearyl dimethyl ammonium chloride, stearyl dimethyl benzyl ammonium chloride, coconut alkyl dimethyl benzyl ammonium chloride, dicoconut alkyl dimethyl ammonium bromide, cetyl pyridinium iodide, and cetyl pyridinium iodide, and cetyl trimethyl ammonium bromide and the like.

An ample description of useful quaternary compounds appears in McCutcheon's "Detergents and Emulsifiers", 1969 Annual, and in "Surface Active Agents" by Schwartz, Perry and Berch, Vol. 11, 1958 (Interscience Publishers), which descriptions are incorporated herein by reference.

The particular surfactant or surfactant mixture chosen for use in the process and products of this invention depends upon the conditions of final utility, including method of manufacture, physical product form, use pH, use temperature, foam control, and soil type. The preferred surfactant system of the invention is selected from nonionic surtactant types. Anionics are incompatible and precipitate in these systems. Nonionic surfactants offer diverse and comprehensive commercial selection, low price; and, most important, excellent detersive effect—meaning surface wetting, soil penetration, soil removal from the surface being cleaned, and soil suspension in the detergent solution. This preference does not suggest exclusion of utility for cationics, or for that sub-class of nonionic entitled semi-polar nonionics, or for those surface-active agents which are characterized by persistent cationic and anionic double ion behavior, thus differing from classical amphoteric, and which are classified as zwitterionic surfactants.

One skilled in the art will understand that inclusion of cationic. semi-polar nonionic, or zwitterionic surfactants; or, mixtures thereof will impart beneficial and/or differentiating utility to various embodiments of the present invention. As example, foam stabilization for detersive compositions designed to be foamed onto equipment or environmental floor, wall and ceiling surfaces; or, gel development for products dispensed as a clinging thin gel onto soiled surfaces; or, for antimicrobial preservation; or, for corrosion prevention—and so forth.

The most preferred surfactant system of the present invention is selected from nonionic surface-active agent classes, or mixtures thereof that impart low foam to the use-dilution, use solution of the detergent composition during application. Preferably, the surfactant or the individual surfactants participating within the surfactant mixture are of themselves low foaming within normal use concentrations and within expected operational application parameters of the detergent composition and cleaning program. In practice, however, there is advantage to blending low foaming surfactants with higher foaming surfactants because the latter often impart superior detersive properties to the detergent composition. Mixtures of low foam and high foam nonlionics and mixtures of low foam nonionics can be useful in the present invention if the foam profile of the combination is low foaming at normal use conditions. Thus high foaming nonionics can be judiciously employed in low or moderate foam systems without departing from the spirit of this invention.

Particularly preferred concentrate embodiments of this invention are designed for clean-in-place (CIP) cleaning systems within food process facilities; and, most particularly for beverage, malt beverage, juice, dairy farm and fluid milk and milk by-product producers. Foam is a major concern in these highly agitated, pump recirculation systems during the cleaning program. Excessive foam reduces flow rate, cavitates recirculation pumps, inhibits detersive solution contact with soiled surfaces, and prolongs drainage. Such occurrences during CIP operations adversely affect cleaning performance and sanitizing efficiencies.

Low foaming is therefore a descriptive detergent characteristic broadly defined as a quantity of foam which does not manifest any of the problems enumerated above when the detergent is incorporated into the cleaning program of a CIP system. Because no foam is the ideal, the issue becomes that of determining what is the maximum level or quantity of foam which can be tolerated within the CIP system without causing observable mechanical or detersive disruption; and, then commercializing only formulas having foam profiles at least below this maximum; but, more practically, significantly below this maximum for assurance of optimum detersive performance and CIP system operation.

Acceptable foam levels in CIP systems have been empirically determined in practice by trial and error. Obviously, commercial products exist today which meet the low foam profile needs of CIP operation. It is therefore, a relatively straightforward task to employ such commercial products as standards for comparison and to establish laboratory foam evaluation devices and test methods which simulate, if not duplicate, CIP program conditions, i.e. agitation, temperature, and concentration parameters.

In practice, the present invention permits incorporation of high concentrations of surfactant as compared to conventional chlorinated, high alkaline CIP and COP cleaners. Certain preferred surfactant or surfactant mixtures of the invention are not generally physically compatible nor chemically stable with the alkalis and chlorine of convention. This major differentiation from the art necessitates not only careful foam profile analysis of surfactants being included into compositions of the invention; but, also demands critical scrutiny of their detersive properties of soil removal and suspension. The present invention relies upon the surfactant system for gross soil removal from equipment surfaces and for soil suspension in the detersive solution. Soil suspension is as important a surfactant property in CIP detersive systems as soil removal to prevent soil redeposition on cleaned surfaces during recirculation and later re-use in CIP systems which save and re-employ the same detersive solution again for several cleaning cycles. Generally, the concentration of surfactant or surfactant mixture useful in use-dilution, use solutions of the present invention ranges from about 0.002% (20 ppm) by weight to about 2% (20,000 ppm) by weight, preferably from about 0.005% (50 ppm) by weight to about 0.1% (1000 ppm) by weight, and most preferably from about 0.05% (500 ppm) by weight to about 0.005% (50 ppm) by weight.

The concentration of surfactant or surfactant mixture useful in the most preferred concentrated embodiment of the present invention ranges from about 5% by weight to about 75% by weight of the total formula weight percent of the enzyme containing composition.

A typical listing of the classes and species of surfactants useful herein appears in U.S. Pat. No. 3,664,961 issued May 23, 1972, to Norris, incorporated herein by reference. *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. Nonionic surfactants useful in the invention arc generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants in the present invention include block polyoxypropylene-polyoxyethylene polymeric compounds based upon propylene glycol, ethylene glycol, glycerol, trimethylolpropane, and ethylenediamine as the initiator reactive hydrogen compound. Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. Examples of commercial compounds of this chemistry are available on the market under the trade name Igepal® manufactured by Rhone-Poulenc and Triton® manufactured by Union Carbide.

Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade name Neodol® manufactured by Shell Chemical Co. and Alfonic® manufactured by Vista Chemical Co. Low foaming alkoxylated nonionics are preferred although other higher foaming alkoxylated noniollics can be used without departing from the spirit of this invention if used in conjunction with low foaming agents so as to control the foam profile of the mixture within the detergent composition as a whole. Examples of nonionic low foaming surfactants include:

Nonionics that are modified by "capping" or "end blocking" the terminal hydroxy group or groups (of multifunctional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

The polyalkylene glycol condensates of U.S. Pat. No. 3,048,548 issued Aug. 7, 1962 to Martin et al., hereby incorporated by reference, having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7 1968 to Lissant et al., incorporated herein by reference, having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al., incorporated herein by reference, corresponding to the formula $Y(C_3H_6O)_n(C_2H_4O)_mH$ wherein Y is the residue of organic compound having from about 1 to 6 carbon atoms and one reactive hydrogen atom, n has an average value of at least about 6.4, as determined by hydroxyl number and m has a value such that the oxyethylene portion constitutes about 10% to about 90% by weight of the molecule.

The conjugated polyoxyalkylene compounds described in U.S. Pat. No. 2,674,619. issued Apr. 6, 1954 to Lundsted et al, incorporated herein by reference, having the formula $Y[(C_3H_6O)_n(C_2H_4O)_mH]_x$ wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has value such that the oxyethylene content of the molecule is from about 10% to about 90% by weight. Compounds falling within the scope of the definition for Y include, for example, propylene glycol, glycerin, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10% to about 90% by weight. In either case the oxypropylene chains may contain optionally, but advantageously, small amounts of ethylene oxide and the oxyethylene chains may contain also optionally, but advantageously, small amounts of propylene oxide. Another nonionic can comprise a silicon surfactant of the invention that comprises a modified dialkyl, preferably a dimethyl polysiloxane. The polysiloxane hydrophobic group is modified with one or more pendent hydrophilic polyalkylene oxide group or groups. Such surfactants provide low surface tension, high wetting, antifoaming and excellent stain removal.

We have found that the silicone nonionic surfactants of the invention, in a detergent composition with another nonionic surfactant can reduce the surface tension of the aqueous solutions, made by dispensing the detergent with an aqueous spray, to between about 35 and 15 dynes/centimeter, preferably between 30 and 15 dynes/centimeter. The silicone surfactants of the invention comprise a polydialkyl siloxane. preferably a polydimethyl siloxane to which polyether, typically polyethylene oxide, groups have been grafted through a hydrosilation reaction. The process results in an alkyl pendent (AP type) copolymer, in which the polyalkylene oxide groups are attached along the siloxane backbone through a series of hydrolytically stable Si—C bond.

These nonionic substituted poly dialkyl siloxane products have the following generic formula:

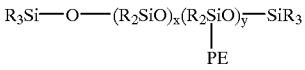

wherein PE represents a nonionic group, preferably $—CH_2—(CH_2)_p—O—(EO)_m(PO)_n—Z$, EO representing ethylene oxide, PO representing propylene oxide, x is a number that ranges from about 0 to about 100, y is a number that ranges from about 1 to 100, m, n and p are numbers that range from about 0 to about 50, $m+n \geqq 1$ and Z represents hydrogen or R wherein each R independently represents a lower ($C_{1-6}$) straight or branched alkyl.

A second class of nonionic silicone surfactants is an alkoxy-end-blocked (AEB type) that are less preferred because the Si—O— bond offers limited resistance to hydrolysis under neutral or slightly alkaline conditions, but breaks down quickly in acidic environments. Another useful surfactant is sold under the SILWET® trademark or under the ABIL® B trademark. One preferred surfactant, SILWET® L77, has the formula:

$$(CH_3)_3Si—O(CH_3)Si(R^1)O—Si(CH_3)_3$$

wherein $R^1 = —CH_2CH_2CH_2—O—[CH_2CH_2O]_zCH_3$; wherein z is 4 to 16 preferably 4 to 12, most preferably 7–9. The surfactant or surfactant admixture of the present invention can be selected from water soluble or water dispersible nonionic, semi-polar nonionic, anionic, cationic, amphoteric, or zwitterionic surface-active agents; or any combination thereof.

Surface active substances are classified as cationic if the charge on the hydrotrope portion of the molecule is positive. Surfactants in which the hydrotrope carries no charge unless the pH is lowered close to neutrality or lower are also included in this group (e.g. alkyl amines). In theory, cationic surfactants may be synthesized from any combination of elements containing an "onium" structure $RnX^+Y^-$ and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, e.g. they are less expensive.

Cationic surfactants refer to compounds containing at least one long carbon chain hydrophobic group and at least one positively charge nitrogen. The long carbon chain group may be attached directly to the nitrogen atom by simple substitution; or more preferably indirectly by a bridging functional group or groups in so-called interrupted alkylamines and amido amines which make the molecule more hydrophilic and hence more water dispersible, more easily water solubilized by co-surfactant mixtures, or water soluble. For increased water solubility, additional primary, secondary or tertiary amino groups can be introduced or the amino nitrogen can be quaternized with low molecular weight alkyl groups, further, the nitrogen can be a member of branched or straight chain moiety of varying degrees of unsaturation; or, of a saturated or unsaturated heterocyclic ring. In addition, cationic surfactants may contain complex linkages having more than one cationic nitrogen atom.

The surfactant compounds classified as amine oxides, amphoterics and zwitterions are themselves cationic in near neutral to acidic pH solutions and overlap surfactant classifications. Polyoxyethylated cationic surfactants behave like nonionic surfactants in alkaline solution and like cationic surfactants in acidic solution. The simplest cationic amines, amine salts and quaternary ammonium compounds. The majority of large volume commercial cationic surfactants can be subdivided into four major classes and additional sub-groups including Alkylamines (and salts). Alkyl imidazolines. Ethoxylated amines and Quaternaries including Alkyl benzyl-dimethylammonium salts, Alkyl benzene salts, Heterocyclic ammonium salts Tetra alkylammonium salts, etc.

As utilized in this invention, cationics are specialty surfactants incorporated for specific effect; for example, detergency in compositions of or below neutral pH; antimicrobial efficacy; thickening or gelling in cooperation with other agents; and so forth.

Ampholytic surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphate, or phosphono. Amphoteric surfactants are subdivided into two major classes: (taken from "Surfactant Encyclopedia" *Cosmetics & Toiletries*. Vol. 104 (2) 69–71 (1989). Include Acyl/dialkyl ethylenediamine derivatives (2-alkyl hydroxyethyl imidazoline derivatives) (and salts), N-alkylamino acids (and salts), 2-alkyl hydroxyethyl imidazoline, etc. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Commercially prominent imidazoline-derived amphoterics include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. The carboxymethylated compounds (glycinates) listed above frequently are called betaines. Betaines are a special class of amphoteric discussed in the section entitled, Zwitterion Surfactants. Long chain N-alkylamino acids are readily prepared by reaction $RNH_2(R=C_8–C_{18})$ fatty amines with halogenated carboxylic acids. Alkylation of the primary amino groups of an amino acids leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine.

Examples of commercial N-alkylamino acid ampholytes having application in this invention include alkyl beta-amino dipropionates, $RN(C_2H_4COOM)_2$ and $RNHC_2H_4COOM$. R is an acyclic hydrophobic group containing from about 8 to about 18 carbon atoms, and M is a cation to neutralize the charge of the anion.

The following table sets forth the formulations currently in development.

TABLE 1

Concentrate Formulations

| Raw Material | Useful | Preferred | More Preferred |
|---|---|---|---|
| Phosphoric Acid | 0.1%–80.0% | 0.1%–60.0% | 0.1%–40.0% |
| Organic Acid | 0.1%–40.0% | 0.1%–20.0% | 0.1%–10.0% |
| Hydrocarbon or Ether Solvent | 0.1%–40.0% | 0.1%–20.0% | 0.1%–10.0% |
| Sequestrant | 0.1%–40.0% | 0.1%–20.0% | 0.1%–10.0% |
| Ether Amine or Quaternary Ammonium Salt | 0.1%–40.0% | 0.1%–20.0% | 0.1%–10.0% |
| Water | 0.1%–80.0% | 0.1%–40.0% | 0.1%–80.0% |

Use solutions are typically prepared by dilution with water resulting in an active concentration of about 100 ppm to about 20,000 ppm.

TABLE 2

EXAMPLES 1 THROUGH 10

| Raw materials[1] | #1 | #2 | #3 | #4 | #5 | #6 | #7 | #8 | #9 | #10 |
|---|---|---|---|---|---|---|---|---|---|---|
| Dowfax 2A1 | 6 | 6 | 6 | 6 | 6 | 6 | 6 | 6 | 6 | 6 |
| C10 F.A. | 1 | 1 | 1 | 1 | 1 | 1 | 1 | 1 | 1 | 1 |
| Butyl Carbitol | 5 | 5 | 5 | | | | | | | |
| Butyl Cellosolve | | | | 5 | 5 | 5 | 5 | 5 | 5 | |
| Dowanol PM | | | | | | 5 | 5 | 5 | | 5 |
| Dowanol DM | | | | | | | | | | |
| Pluronic L-65 | | | | | | | | | | 5.5 |
| Hydroxy Acetic Acid | 5 | 5 | 5 | 5 | | | | | 5 | 5 |
| Phos Acid (75%) | 65 | 65 | 65 | 65 | 65 | 65 | 65 | 65 | 65 | 65 |
| Abil 8852 | | 1 | | | | | | | 0.5 | 1 |
| NAS 8RF | | 2 | | | | | | | | |
| Lactic Acid (88%) | | | | | 5 | 5 | 5 | 5 | | |
| L.C. Dequest 2000 | | | 2 | | | | | | | |

TABLE 2-continued

| EXAMPLES 1 THROUGH 10 | | | | | | | | | | |
|---|---|---|---|---|---|---|---|---|---|---|
| Raw materials[1] | #1 | #2 | #3 | #4 | #5 | #6 | #7 | #8 | #9 | #10 |
| Water | 18 | 15 | 16 | 17 | 18 | 13 | 10 | 10 | 10 | 6.5 |
| PS 236 Phos Ester | | | | 1 | | | | | | |
| BL-330 | | | | | | | 3 | | | |
| Triton CF-32 | | | | | | | | 3 | | |
| DMSO | | | | | | | | | 5 | |
| LF428 | | | | | | | | | 2.5 | |
| Total | 100.00% | 100.00% | 100.00% | 100.00% | 100.00% | 100.00% | 100.00% | 100.00% | 100.00% | 100.00% |

[1]See raw materials page for identity.

TABLE 3

| EXAMPLES 11 THROUGH 20 | | | | | | | | | |
|---|---|---|---|---|---|---|---|---|---|
| Raw materials | #11 | #12 | #13 | #15 | #16 | #17 | #18 | #19 | #20 |
| Dowfax 2A1 | 6 | 6 | 6 | | | | | | |
| Q372 | | | | 2.5 | 2.5 | | 2.5 | | |
| IPA 99% | | | | 5 | 5 | 5 | 5 | 5 | 5 |
| Rhodaterge BCC | | | | 5 | | | | | |
| Bardac LF | | | | | | 2.5 | | | |
| Mirataine ASC | | | | 5 | 5 | 5 | | | |
| C10 F.A. | 1 | 1 | 1 | | | | | | |
| Butyl Carbitol | | | | | | | | | |
| Butyl Cellosolve | 5 | 5 | 5 | 5 | 5 | 5 | 5 | 5 | 5 |
| Dowanol PM | 5 | 5 | 5 | | | | | | |
| Dowanol DM | | | | | | | | | |
| Pluronic L-65 | | | 3 | | | | | | |
| Hydroxy Acetic Acid | 5 | | | | | | | | |
| Phos Acid (75%) | 65 | 65 | 65 | 30 | 30 | 30 | 30 | 30 | 30 |
| Abil 8852 | 1 | | | | | | | | |
| NAS 8RF | | | | | | | | | |
| Lactic Acid (88%) | | | | 5 | 5 | 5 | 5 | 5 | 5 |
| L.C. Dequest 2000 | | 1 | 1 | 2.5 | 2.5 | 2.5 | 2.5 | 2.5 | 2.5 |
| Water | 9 | 6 | 9 | 40 | 45 | 45 | 50 | 50 | 50 |
| PS 236 Phos Ester | | | | | | | | | |
| BL-330 | | | | | | | | | |
| Triton CF-32 | | | | | | | | | |
| Dehydol TA-30 | 3 | 3 | | | | | | | |
| PA-10 ether amine | | | | | | | | 2.5 | |
| PA-14 ether amine | | | | | | | | | 2.5 |
| LF428 | | 3 | 5 | | | | | | |
| Total | 100.00% | 95.00% | 100.00% | 100.00% | 100.00% | 100.00% | 100.00% | 100.00% | 100.00% |

TABLE 4

| EXAMPLES 21 THROUGH 27 | | | |
|---|---|---|---|
| Raw materials | #21 | #22 | #23 |
| Q372 | 5 | | |
| IPA 99% | 5 | | |
| Rhodaterge BCC | | | |
| Bardac LF | | | |
| Mirataine ASC | | | |
| Butyl Carbitol | | | |
| Butyl Cellosolve | 5 | 5 | 10 |
| Pluronic L-65 | | | |
| Hydroxy Acetic Acid | | | |
| Phos Acid (75%) | 30 | 30 | 30 |
| Abil 8852 | | | |
| NAS 8RF | | | |
| Lactic Acid (88%) | 5 | 5 | 5 |
| L.C. Dequest 2000 | 2.5 | 2.5 | 2.5 |
| Water | 45 | 55 | 50 |

TABLE 4-continued

| EXAMPLES 21 THROUGH 27 | | | |
|---|---|---|---|
| Raw materials | #21 | #22 | #23 |
| PA-10 ether amine | 2.5 | 2.5 | 2.5 |
| PA-14 ether amine | | | |
| LF428 | | | |
| Total | 100.00% | 100.00% | 100.00% |

TABLE 5

| RAW MATERIALS DETAIL | |
|---|---|
| Dowfax 2A1 | Alkyl diphenyl oxide sulfonate |
| C10 FA | $C_{10}$ Fatty acid |
| Butyl Carbitol | 2-(2-butoxyethoxy) ethanol |
| Butyl Cellosolve | Butoxy ethanol |
| Dowanol DM | Dimethylene glycol methyl ether |
| Dowanol PM | Propylene glycol methyl ether |

TABLE 5-continued

| RAW MATERIALS DETAIL | |
|---|---|
| Pluronic L-65 | Nonionic |
| Hydroxy Acetic Acid | |
| $H_3PO_4$ (75% Aqueous) | |
| Abil 8852 | Silicon nonionic surfactant |
| NAS 8RF | Alkyl sulfoniate |
| Lactic Acid (88%) | |
| L.C. Dequest 2000 | Amino-(trimethylene phosphoric acid) salt |
| PS 236 Phos Ester | Alkyl phosphonate |
| BL 330 | Alcohol ethoxylate chlorine capped (3 moles EO) |
| Triton CF 32 | Alcohol ethoxylate |
| DMSO | Dimethyl sulfoxide |
| LF428 | nonionic multiblock (EO) (PO) surfactant |
| Q372 | Dimethyl alkyl benzyl quaternary ammonium chloride |
| IPA 99% | Isopropyl alcohol |
| Rhodaterge BCC | Rhone - Polene nonionic/solvent premix |
| Bardac LF Quat | Dimethyl $C_{6-12}$ dialky quaternary ammonium chloride |
| Mirataine ASC | amphoteric amido propyl betaine |
| PA-10 ether amine | isohexyloxypropyl amine |
| PA-14 ether amine | isodecyloxypropyl amine |

OBJECTIVE:

The objective of the analysis was to determine the sanitizing efficacy of Ex. 19 and Ex. 20 against *Staphylococcus aureus* ATCC 6538, *Esherichia coli* ATCC 11229 and 1:1 mixed inoculum of yeast.

TEST METHOD:

Germicidal and Detergent Sanitizing Action of Disinfectants—Method AOAC 960.09-Chap. 6, p. 9, sec. 6.303

METHOD PARAMETERS:

| Test Substance Name | Diluent | Concentration | mL of Test Substance | mL of Diluent |
|---|---|---|---|---|
| Ex. 19 | 500 ppm Hard Water | 1.0% | 10.0 | 990.0 |
| Ex. 20 | 500 ppm Hard Water | 1.0% | 10.0 | 990.0 |

| | | |
|---|---|---|
| Test Systems: | *Staphylococcus aureus* | ATCC 6538 |
| | *Escherichia coli* | ATCC 11229 |
| | 1:1 Yeast Mixture of: | |
| | *Candida albicans* | ATCC 18804 |
| | *Saccharomyces cervisciae* | ATCC 834 |

Test Temperature: 25° C.

Exposure Time: 30 minutes and 60 minutes

Neutralizer: Chambers Solution

Dilutions Plated: $10^{-1}$, $10^{-1}$, $10^{-5}$

Subculture Medium: Tryptone Glucose Extract Agar (cultivation of Bacteria) Sabouraud Dextrose Agar (for cultivation of yeast)

Incubation: 37° C. for 48 hours (for cultivation of bacteria) 26° C. for 72 hours (for cultivation of yeast)

RESULTS

| Organism | Inoculum Numbers (CFU/mL) A | B | Average |
|---|---|---|---|
| *E. coli* ATCC 11229 | $51 \times 10^7$ | $55 \times 10^7$ | $5.3 \times 10^8$ |
| *S. aureus* ATCC 6538 | $132 \times 10^6$ | $141 \times 10^6$ | $1.4 \times 10^8$ |
| Mixed Yeast | $224 \times 10^4$ | $226 \times 10^4$ | $2.3 \times 10^6$ |

| Test Substance | Exposure Times (Minutes) | Survivors (CFU/mL) | Average Survivors (CFU/mL) | Log Reduction | Percent Reduction |
|---|---|---|---|---|---|
| | | *Escherichia coli* ATCC 11229 | | | |
| Ex. 19 | 30 | $>10^7$, $>10^7$ | $>10^7$ | <1.72 | <98.113% |
| Ex. 19 | 60 | 20, $21 \times 10^3$ | $2.0 \times 10^4$ | 4.42 | 99.996% |
| Ex. 20 | 30 | <10, <10 | <10 | >7.72 | >99.999% |
| Ex. 20 | 60 | <10, <10 | <10 | >7.72 | >99.999% |
| | | *Staphylococcus aureus* ATCC 6538 | | | |
| Ex. 19 | 30 | $>10^7$, $>10^7$ | $>10^7$ | <1.15 | <92.850% |
| Ex. 19 | 60 | $>10^5$, $665 \times 10^5$ | $3.3 \times 10^7$ | 0.63 | 76.429% |
| Ex. 20 | 30 | <10, <10 | <10 | >7.15 | >99.999% |
| Ex. 20 | 60 | <10, <10 | <10 | >7.15 | >99.999% |
| | | Mixed Yeast inoculum of *Candida albicans* ATCC 18804 and *Saccharomyces cervisciae* ATCC 834 | | | |
| Ex. 19 | 30 | $20{,}386 \times 10^5$ | $2.0 \times 10^7$ | No Reduction | No Reduction |
| Ex. 19 | 60 | $3{,}316 \times 10^5$ | $1.6 \times 10^7$ | No Reduction | No Reduction |
| Ex. 20 | 30 | $13{,}531 \times 10^5$ | $2.7 \times 10^7$ | No Reduction | No Reduction |
| Ex. 20 | 60 | <10, <10 | <10 | >5.36 | >99.999% |

CONCLUSIONS:

A neutralization control test was performed on both test substances (Ex. 19 and Ex. 20). The Neutralizer, Chambers Solution, was found to be an effective neutralizer for these products and was not found to be detrimental to the test systems employed.

Ex. 19, with a 30 minute exposure time at 25° C., achieved <98.113% percent reduction against *Escherichia coli* ATCC 11229 and <92.850% against *Staphylococcus aureus* ATCC 6538. Ex. 19 with a 60 minute exposure time at 25° C. achieved a 99.996% reduction against *Escherichia coli* ATCC 11229, a 76.429% reduction against *Staphylococcus aureus* ATCC 653 and achieve no percent reduction against the mixed yeast inoculum with a 30 minute or 60 minute exposure time. Ex. 20 with a 30 minute exposure time at 25° C., achieved a >99.999% against *Escherichia coli* ATCC 11229 and a >99.999% reduction against *Staphylococcus aureus* ATCC 6538. Ex. 20 with a 30 minute exposure time at 25° C. achieved no percent reduction against the mixed yeast inoculum. Ex. 20 with a 60 minute exposure time at 25° C. achieved a >99.999% reduction against *Escherichia coli* ATCC 11229, *Staphylococclis aureus* ATCC 653 and the mixed yeast inoculum.

OBJECTIVE:

The objective of the analysis was to determine the food contact surface sanitizing efficacy of Ex. 16 and Ex. 17 against *Staphylococcus aureus* ATCC 6538 and *Escherichia coli* ATCC 11229.

TEST METHOD:

Germicidal and Detergent Sanitizing Action of Disinfectants—Method AOAC 960.09-Chap. 6, p. 9, sec. 6.303

METHOD PARAMETERS:

| Test Substance Name | Diluent | Conc | mL of Test Substance | mL of Diluent |
|---|---|---|---|---|
| Ex 16 | 500 ppm synthetic hard water | 0.50% | 2.5 | Volume brought to 500 mL |
| Ex. 16 | 500 ppm synthetic hard water | 1.0% | 5.0 | Volume brought to 500 mL |
| Ex. 17 | 500 ppm synthetic hard water | 0.50% | 2.5 | Volume brought to 500 mL |
| Ex. 17 | 500 ppm synthetic hard water | 1.0% | 5.0 | Volume brought to 500 mL |

| Test Systems: | *Staphylococcus aureus* | ATCC 6538 |
|---|---|---|
| | *Escherichia coli* | ATCC 11229 |

Test Temperature: room temperature
Exposure Time: 15 and 30 minutes
Neutralizer: Chambers
Subculture Medium: Tryptone Glucose Extract Agar
Incubation: 37° C. for 48 hours

RESULTS

| Organism | Inoculum Numbers (CFU/mL) A | B | C | Average |
|---|---|---|---|---|
| *S. aureus* ATCC 6538 | $132 \times 10^6$ | $96 \times 10^6$ | $118 \times 10^6$ | $1.2 \times 10^8$ |
| *E. coli* ATCC 11229 | $145 \times 10^6$ | $156 \times 10^6$ | $121 \times 10^6$ | $1.4 \times 10^8$ |

| Test Substance | Conc. | Time point | Survivors (CFU/mL) | Average Survivors (CFU/mL) | Log R | Percent Reduction |
|---|---|---|---|---|---|---|
| | | | Staphylococcus aureus ATCC 6538 | | | |
| Ex. 16 | 0.50% | 15 min. | $41 \times 10^3$<br>$42 \times 10^1$ | $2.1 \times 10^4$ | 3.76 | 99.983 |
| Ex. 16 | 0.50% | 30 min. | $33, 34 \times 10^1$ | $3.4 \times 10^2$ | 5.55 | 99.999 |
| Ex. 16 | 1.0% | 15 min. | $40, 34 \times 10^1$ | $3.7 \times 10^2$ | 5.51 | 99.999 |
| Ex. 16 | 1.0% | 30 min. | $28, 31 \times 10^1$ | $3.0 \times 10^2$ | 5.60 | 99.999 |
| Ex. 17 | 0.50% | 15 min. | $136, 138 \times 10^5$ | $1.4 \times 10^7$ | 0.93 | 88.333 |
| Ex. 17 | 0.50% | 30 min. | $49, 43 \times 10^1$ | $4.6 \times 10^6$ | 1.42 | 96.167 |
| Ex. 17 | 1.0% | 15 min. | $320 \times 10^1$<br>$40 \times 10^3$ | $2.2 \times 10^4$ | 3.74 | 99.982 |
| Ex. 17 | 1.0% | 30 min. | $30, 37 \times 10^1$ | $3.4 \times 10^2$ | 5.55 | 99.999 |
| | | | *Escherichia coli* ATCC 11229 | | | |
| Ex. 16 | 0.50% | 15 min. | $32, 26 \times 10^1$ | $2.9 \times 10^2$ | 5.68 | 99.999 |

-continued

| | | | | | | |
|---|---|---|---|---|---|---|
| Ex. 16 | 0.50% | 30 min. | 30, 30 × $10^1$ | 3.0 × $10^2$ | 5.67 | 99.999 |
| Ex. 16 | 1.0% | 15 min. | 33, 36 × $10^1$ | 3.5 × $10^2$ | 5.60 | 99.999 |
| Ex. 16 | 1.0% | 30 min. | 30, 33 × $10^1$ | 3.2 × $10^2$ | 5.64 | 99.999 |
| Ex. 17 | 0.50% | 15 min. | 29, 36 × $10^1$ | 3.3 × $10^2$ | 5.63 | 99.999 |
| Ex. 17 | 0.50% | 30 min. | 37, 33 × $10^1$ | 3.5 × $10^2$ | 5.60 | 99.999 |
| Ex. 17 | 1.0% | 15 min. | 32, 32 × $10^1$ | 3.2 × $10^2$ | 5.64 | 99.999 |
| Ex. 17 | 1.0% | 30 min. | 28, 29 × $10^1$ | 2.9 × $10^2$ | 5.68 | 99.999 |

A neutralization test was performed. The test substances were effectively neutralized and Chambers was observed to not be detrimental to the cells.

CONCLUSIONS:

Ex. 16 achieved >99.999 percent reduction against *Staphylococcus aureus* ATCC 6538 at all time points except 0.50% at 15 minutes. However, one plate from this sample showed counts in the $10^1$ range and the other in the $10^3$ range. This result should be confirmed. Ex. 16 was efficacious against *Escherichia coli* ATCC 11229 at all concentrations and time points.

Ex. 17 achieved >99.999 percent reduction against *Staphylococcus aureus* ATCC 6538 only at a concentration of 1% with a 30 minute exposure time. It was efficacious against *Escherichia coli* ATCC 11229 at all concentrations and time points.

Cleaning Characteristics

Method

Used 2.0% solution, 30 min concentration, start 5° C.—finish 10–12° C., 500 rpm w/1½ stir bar.

Formulas #1–#14: Removed some soil with limited removal of fermentation ring

Formula #15, #16 and #18: Removed 95–99% of fermentation ring soil; some yeast spots remain; performance equal or better than commercial product Trimeta HC (a phosphonate, phosphoric acid and nonionic surfacant blend). This product cleaned well but had little or no antimicrobial properties.

Formula #17: 80% removal of fermentation ring. Spots of yeast remaining

Formula #19: Better than #1 through #14, but removed 70%+ of fermentation ring.

Foam Profiles on Cleaners

The foaming characteristics of comparative compositions and the compositions of the invention were tested. The cylinder foam test: used. One hundred milliliters of test solution (concentration in table below); were tested. In the procedure, 10 inversions were conducted at ambient (room, Temp), in deionized, water. The test apparatus was a 250 ml graduated cylinder. The formulae, particularly Examples 16 through 20 exhibited excellent low foam characteristics.

| 1.0% | | 2.0% | | |
|---|---|---|---|---|
| Time (min) | Foam (ml) | Time (min) | Foam (ml) | Soln Temp |
| | Test Formula was Example 15 | | | |
| 0 | 50 | 0 | 50 | 22° C. |
| 1 | 45 | 1 | 45 | |
| 3 | 40 | 3 | 45 | |
| 5 | 40 | 5 | 40 | |
| | Test Formula was Example 16 | | | |
| 0 | 60 | 0 | 90 | 22° C. |
| 1 | 60 | 1 | 88 | |
| 3 | 50 | 3 | 80 | |
| 5 | 45 | 5 | 60 | |

-continued

| 1.0% | | 2.0% | |
|---|---|---|---|
| Time (min) | Foam (ml) | Time (min) | Foam (ml) |
| | Test Formula was Example 17 | | |
| 0 | 35 | 0 | 50 |
| 1 | 15 | 1 | 30 |
| 3 | 10 | 3 | 10 |
| 5 | 10 | 5 | |
| 1.0% | | 2.0% | |
| Time (min) | Foam (ml) | Time (min) | Foam (ml) |
| | Test Formula was Example 18 | | |
| 0 | 60 | 0 | 60 |
| 1 | 20 | 1 | 30 |
| 3 | 15 | 3 | 15 |
| 5 | 10 | 5 | 10 |
| | Test Formula was Example 19 | | |
| 0 | 15 | 0 | 20 |
| 1 | 2 | 1 | 2 |
| 3 | 2 | 3 | 2 |
| 5 | 2 | 5 | 2 |
| | Test Formula was Example 20 | | |
| 0 | 15 | 0 | 20 |
| 1 | 2 | 1 | 2 |
| 3 | 2 | 3 | 2 |
| 5 | 2 | 5 | 2 |

The forgoing specification examples and data serve to explain the aspects of the invention identified to date. The invention can comprise a variety of compositions methods and embodiments without departing from the spirit and scope of the invention. The invention is found in the claims hereinafter appended.

We claim:

1. A low foaming acid cleaner composition, the composition comprising:

(a) about 1 to 80 wt % of phosphoric acid;

(b) about 0.1 to 40 wt % of an organic carboxylic acid;

(c) about 0.1 to 40 wt % of a solvent comprising a hydrocarbon ether or a hydrocarbon alcohol;

(d) about 0.1 to 40 wt % of a sequestrant; and (e) about 0.1 to 40 wt % of an ether amine composition comprising the formula:

$$[R_1—O—R_2]_n—N[R]_{3-n}$$

wherein R is independently —H, —$R_1$ or —$R_2$—$NH_2$, $R_1$ is a $C_{1-24}$ alkyl group, $R_2$ is a $C_{1-6}$ alkylene group and n is a number of 1 or 2;

wherein the composition has a pH of less than 5 and can remove either carbohydrate or proteinaceous soil from hard surfaces.

2. The formula of claim 1 wherein the organic acid comprises lactic acid, gluconic acid, citric acid, hydroxyacetic acid or mixtures thereof.

3. The composition of claim 1 wherein the solvent comprises a $C_{1-6}$ lower alkyl cellosolve or a $C_{1-6}$ lower alkyl carbitol.

4. The composition of claim 1 wherein the solvent comprises a alkylene glycol mono-$C_{1-6}$-alkyl ether.

5. The composition of claim 1 wherein the ether amine comprises a compound of the formula:

$$R_1—O—R_2—NH_2$$

wherein $R_1$ is a $C_{1-24}$ alkyl group, $R_2$ is a $C_{1-6}$ alkylene group.

6. The composition of claim 1 wherein the solvent comprises a mixture of a $C_{2-5}$ lower alkanol and a $C_{1-6}$ alkyl cellusolve.

7. The composition of claim 1 wherein the sequestrant comprises an amino-(trimethylene phosphonic acid) or salt thereof.

8. The composition of claim 1 wherein the ether amine comprises a compound of the formula:

$$R_3—O—R_4—NH_2$$

wherein $R_3$ comprises a fatty alkyl group having 8–24 carbon atoms $R_4$ comprises a $C_{2-6}$ alkylene group.

9. The composition of claim 8 wherein the ether amine is a $C_{4-12}$ alkyl-oxypropyl amine.

10. The composition of claim 8 wherein the ether amine is a isodecyl-oxypropyl amine.

11. A clean-in-place method of cleaning a beverage manufacturing unit, said method capable of removing carbohydrate and proteinaceous soils, said method comprising the steps of:

(a) contacting containers and conduits in a beverage manufacturing unit with a cleaning composition comprising:

(i) about 1 to 40 wt % of phosphoric acid;

(ii) about 0.01 to 10 wt % of an organic carboxylic acid;

(iii) about 0.01 to 10 wt % of a solvent comprising a hydrocarbon ether or a hydrocarbon alcohol;

(iv) about 0.01 to 10 wt % of a phosphonate sequestrant; and (v) about 0.01 to 10 wt % of an ether amine composition comprising the formula:

$$[R_1—O—R_2]_n—N[R]_{3-n}$$

wherein R is independently —H, —$R_1$ or —$R_2$—$NH_2$, $R_1$ is a $C_{1-24}$ alkyl group, $R_2$ is a $C_{1-6}$ alkylene group and n is a number of 1 or 2;

wherein the composition has a pH of less than 5 and is contacted with a manufacturing unit for sufficient period of time to remove carbohydrate or proteinaceous soils; and (b) removing the composition from the manufacturing unit for the purpose of reinitiating beverage manufacture.

12. The method of claim 11 wherein the cleaning composition is free of a surfactant composition and the organic acid comprises lactic acid, gluconic acid, citric acid, hydroxyacetic acid or mixtures thereof.

13. The composition of claim 11 wherein the solvent comprises a $C_{1-6}$ lower alkanol.

14. The composition of claim 11 wherein the solvent comprises a ethylene glycol mono-$C_{1-6}$-alkyl ether.

15. The method of claim 11 wherein the solvent comprises a compound of the formula:

$$R_1—[O—R_2]_n—OH$$

wherein $R_1$ is a $C_{1-24}$ alkyl group, $R_2$ is a $C_{1-6}$ alkylene group and n is a number of 1 to 3.

16. The method of claim 11 wherein the solvent comprises a mixture of a $C_{2-5}$ lower alkanol and a $C_{1-6}$ alkyl cellusolve.

17. The method of claim 11 wherein the phosphonate comprises an amino-(trimethylene phosphonic acid) or salt thereof.

18. The method of claim 11 wherein the ether amine comprises a compound of the formula:

$$R_3—O—R_4—NH_2$$

wherein $R_3$ comprises a fatty alkyl group having 8–24 carbon atoms, $R_4$ comprises a $C_{2-6}$ alkylene group.

19. The method of claim 18 wherein the ether amine is a $C_{4-12}$ linear or branched alkyl-oxypropyl amine.

20. The method of claim 18 wherein the ether amine is a isodecyl-oxypropyl amine.

21. A low foaming acid cleaner composition, the composition comprising:

(a) about 1 to 80 wt % of food grade acid;

(b) about 0.1 to 40 wt % of a solvent comprising a hydrocarbon ether or a hydrocarbon alcohol;

(c) about 0.1 to 40 wt. % of a sequestrant; and (d) about 0.1 to 40 wt % of an ether amine composition comprising the formula:

$$[R_1—O—R_2]_n—N[R]_{3-n}$$

wherein R is independently —H, —$R_1$ or —$R_2$—$NH_2$, $R_1$ is a $C_{1-24}$ alkyl group, $R_2$ is a $C_{1-6}$ alkylene group and n is a number of 1 or 2;

wherein the composition has a pH of less than 6 and can remove either carbohydrate or proteinaceous soil from hard surfaces.

22. The composition of claim 21 with a pH less than 5.

23. The composition of claim 21 also comprising an organic acid.

24. The composition of claim 21 wherein the organic acid comprises lactic acid, gluconic acid, citric acid, hydroxyacetic acid or mixtures thereof.

25. The composition of claim 21 wherein the food grade acid is phosphoric acid.

26. The composition of claim 21 wherein the solvent comprises a $C_{1-6}$ lower alkanol.

27. The composition of claim 21 wherein the solvent comprises an ethylene glycol mono-$C_{1-6}$-alkyl ether.

28. The composition of claim 21 wherein the ether amine comprises a compound of the formula:

$$R_1—O—R_2—NH_2$$

wherein $R_1$ is a $C_{1-24}$ alkyl group, $R_2$ is a $C_{1-6}$ alkylene group.

29. The composition of claim 21 wherein the solvent comprises a mixture of a $C_{2-5}$ lower alkanol and a $C_{1-6}$ alkyl cellulsolve.

30. The composition of claim 21 wherein the sequestrant comprises an amino-(trimethylene phosphonic acid) or salt thereof.

31. The composition of claim 21 wherein the ether amine comprises a compound of the formula:

$$R_3—O—R_4—NH_2$$

wherein $R_3$ comprises a fatty alkyl group having 8–24 carbon atoms, $R_4$ comprises a $C_{2-6}$ alkylene group.

32. The composition of claim 31 wherein the ether amine is a $C_{4-12}$ alkyl-oxypropyl amine.

33. The composition of claim 31 wherein the ether amine is a isodecyl-oxypropyl amine.

* * * * *